US006039490A

United States Patent [19]

Banks et al.

[11] Patent Number: 6,039,490

[45] Date of Patent: Mar. 21, 2000

[54] DRINKING STRAW CLEANING SYSTEM

[76] Inventors: Beverly L. Banks; Tony C. Banks, both of 5606 John Burruss Rd., Cumming, Ga. 30040

[21] Appl. No.: 09/251,866

[22] Filed: Feb. 17, 1999

[51] Int. Cl.[7] ..... B43M 11/06

[52] U.S. Cl. ..... 401/185; 15/136; 15/140; 15/104.2; 15/406; 15/607; 15/395; 239/33

[58] Field of Search ..... 401/185; 15/136, 15/140, 607, 104.2, 164, 405, 406, 395; 239/33

[56] References Cited

U.S. PATENT DOCUMENTS

| | | | |
|---|---|---|---|
| D. 324,776 | 3/1992 | Griffin et al. | D4/114 |
| D. 346,698 | 5/1994 | Hinnant | D4/114 |
| D. 361,893 | 9/1995 | Tehrani | D4/114 |
| 814,235 | 3/1906 | Rosenstein | 401/185 |
| 1,635,176 | 7/1927 | Dorment | 401/185 |
| 2,051,340 | 8/1936 | Lomas | 15/136 |
| 2,143,712 | 1/1939 | Rissman | 15/140 |
| 2,973,538 | 3/1961 | Thomson | 15/607 |
| 3,085,272 | 4/1963 | Weichselbaum | 15/164 |
| 4,718,778 | 1/1988 | Ichikawa | 239/33 |
| 5,462,377 | 10/1995 | Martinez, Jr. et al. | 401/185 |
| 5,926,895 | 7/1999 | Roy | 15/104.2 |

FOREIGN PATENT DOCUMENTS

| | | | |
|---|---|---|---|
| 462997 | 7/1928 | Germany | 15/395 |

*Primary Examiner*—Steven O. Douglas
*Assistant Examiner*—Khoa D. Huynh
*Attorney, Agent, or Firm*—Joseph N. Breaux

[57] ABSTRACT

A cleaning system for cleaning drinking straws and the like that includes a flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure; a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; and a straw end sealing cap securable over an open end of a drinking straw for maintaining cleaning solution within a straw passageway formed through the drinking straw during a period of brushing with the flexible tubular brush structure. The resilient, spherical squeeze bulb reservoir has an internal cleaning solution reservoir cavity in connection with an internally threaded fitting companionately threaded to engage and connect with the externally threaded squeeze bulb reservoir connecting end of the flexible tubular brush structure.

2 Claims, 2 Drawing Sheets

DRINKING STRAW CLEANING SYSTEM

TECHNICAL FIELD

The present invention relates to cleaning systems and more particularly to a drinking straw cleaning system for cleaning drinking straws and the like that includes a flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure; a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; a straw end sealing cap securable over an open end of a drinking straw for maintaining cleaning solution within a straw passageway formed through the drinking straw during a period of brushing with the flexible tubular brush structure; the resilient, spherical squeeze bulb reservoir having an internal cleaning solution reservoir cavity in connection with an internally threaded fitting companionately threaded to engage and connect with the externally threaded squeeze bulb reservoir connecting end of the flexible tubular brush structure.

BACKGROUND ART

Many reusable drinking vessels are provided with drinking straws that can be difficult to clean. It would be a benefit, therefore, to have a drinking straw cleaning system that could be used to thoroughly clean the fluid passageway of a drinking straw.

GENERAL SUMMARY DISCUSSION OF INVENTION

It is thus an object of the invention to provide a drinking straw cleaning system that includes a flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure and a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; a straw end sealing cap securable over an open end of a drinking straw for maintaining cleaning solution within a straw passageway formed through the drinking straw during a period of brushing with the flexible tubular brush structure; the resilient, spherical squeeze bulb reservoir having an internal cleaning solution reservoir cavity in connection with an internally threaded fitting companionately threaded to engage and connect with the externally threaded squeeze bulb reservoir connecting end of the flexible tubular brush structure.

Accordingly, a drinking straw cleaning system is provided. The drinking straw cleaning system includes a flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure; a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; a straw end sealing cap securable over an open end of a drinking straw for maintaining cleaning solution within a straw passageway formed through the drinking straw during a period of brushing with the flexible tubular brush structure; the resilient, spherical squeeze bulb reservoir having an internal cleaning solution reservoir cavity in connection with an internally threaded fitting companionately threaded to engage and connect with the externally threaded squeeze bulb reservoir connecting end of the flexible tubular brush structure.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
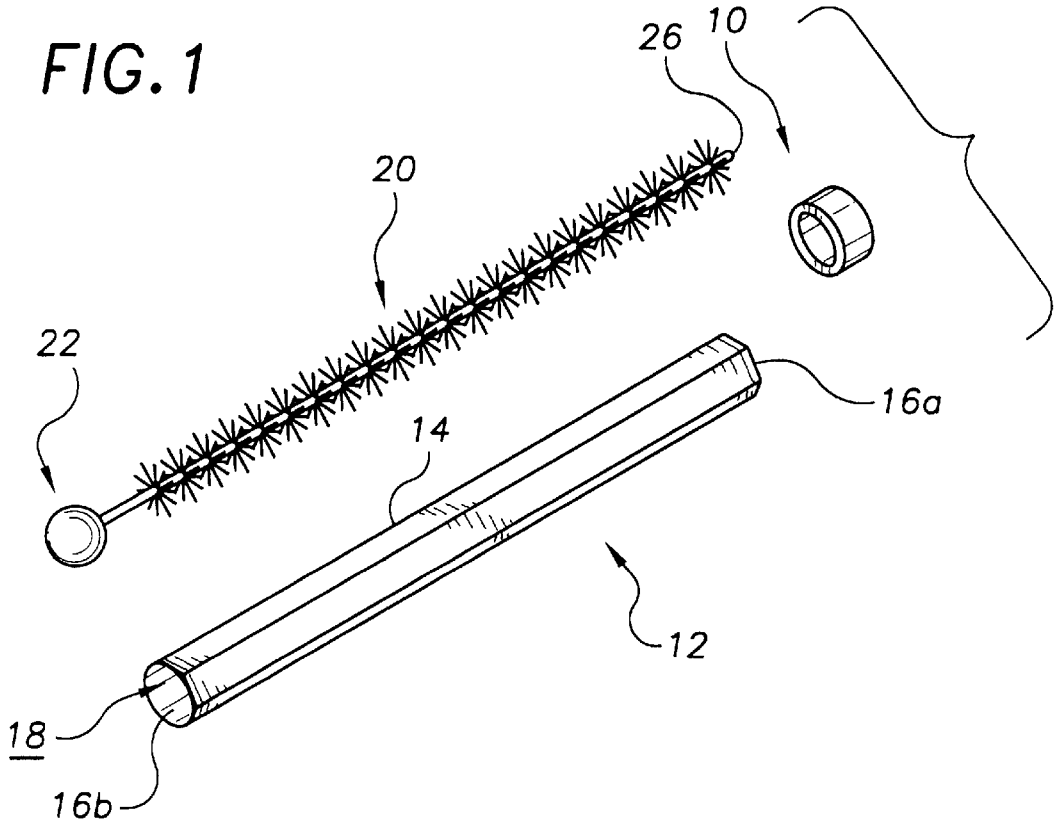
FIG. 1 is a perspective view of an exemplary embodiment of the drinking straw cleaning system of the present invention showing the flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure; a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; an optional straw end sealing cap that can optionally be used to retain cleaning solution within the straw passageway during a period of brushing with the flexible tubular brush structure; and a representative straw having an elongated tubular construction defining a fluid passageway between two open straw ends.

FIG. 1 shows an exemplary embodiment of the drinking straw cleaning system of the present invention, generally designated 10, in combination with a representative drinking straw, generally designated 12. Representative drinking straw 12 is an elongated plastic tube 14 open at both ends 16*a*,16*b* and connected by a fluid passageway 18 although the term drinking straw as used herein is used to mean any tubular structure used to suck consumable fluids from a reservoir.

Figure 2:
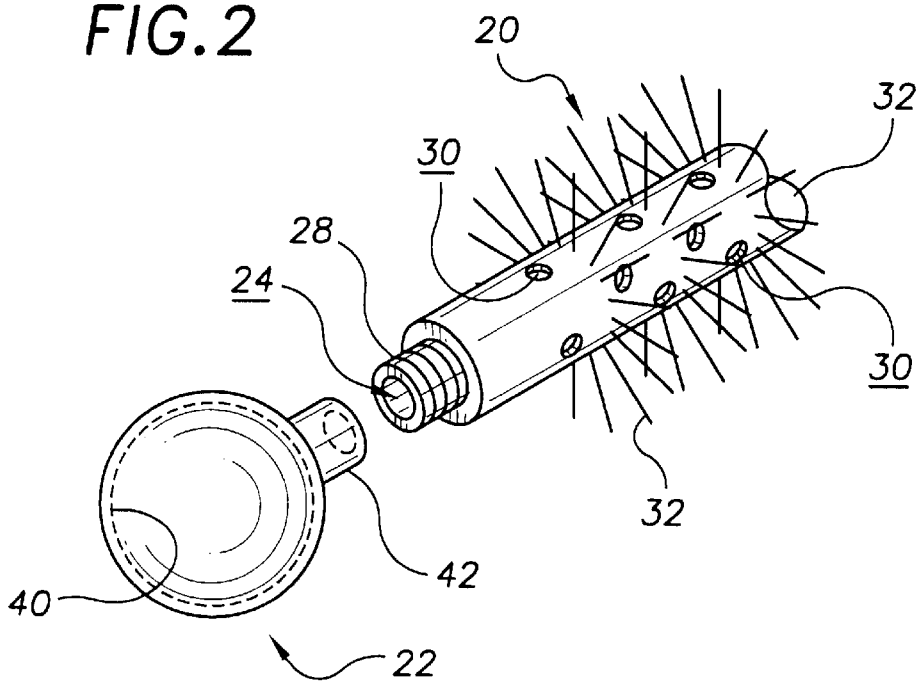
FIG. 2 is a partial perspective view showing the open, externally threaded squeeze bulb reservoir connecting end of the flexible tubular brush structure including a number of the cleaning solution dispensing orifices and a number of the multi-length bristles extending radially outward from the flexible tubular brush structure and the resilient, spherical squeeze bulb reservoir having an internal cleaning solution reservoir cavity in connection with an internally threaded fitting companionately threaded to engage and connect with the externally threaded squeeze bulb reservoir connecting end of the flexible tubular brush structure.

Drinking straw cleaning system 10 includes a flexible, tubular brush structure, generally designated 20, and a resilient, spherical squeeze bulb reservoir, generally designated 22. Referring now to FIG. 2, flexible, tubular brush structure 20 has a tubular cavity 24 formed therein along the length thereof between a closed insertion end 26 (FIG. 1) and an open ended, threaded squeeze bulb reservoir connecting end 28. Flexible, tubular brush structure 20 has a number of cleaning solution dispensing orifices 30 provided along the length of flexible tubular brush structure 20 and a number of multi-length bristles 32 extending radially outward from flexible tubular brush structure 20. Multi-length bristles 32 are used to provide scrubbing structures suitable for effectively scrubbing int interior surfaces of drinking straws having accordion fold bend structures and the like. Flexible, tubular brush structure 20 is constructed from a section of flexible plastic tubing and is flexible to allow for cleaning drinking straws provided with curved configurations.

Resilient, spherical squeeze bulb reservoir 22 is molded from a resilient plastic and has an internal cleaning solution reservoir cavity 40 for holding a supply of cleaning solutions such as detergent solutions and the like that are injected forcefully into the passageway 18 (FIG. 1) of a drinking straw 12 (FIG. 1) to free stuck on sugary coating and debris such as orange juice pulp. Internal cleaning solution reservoir cavity 40 is in connection with a threaded fitting 42 that is companionately threaded to engage and connect with the threaded squeeze bulb reservoir connecting end 28 of flexible tubular brush structure 20.

Figure 3:
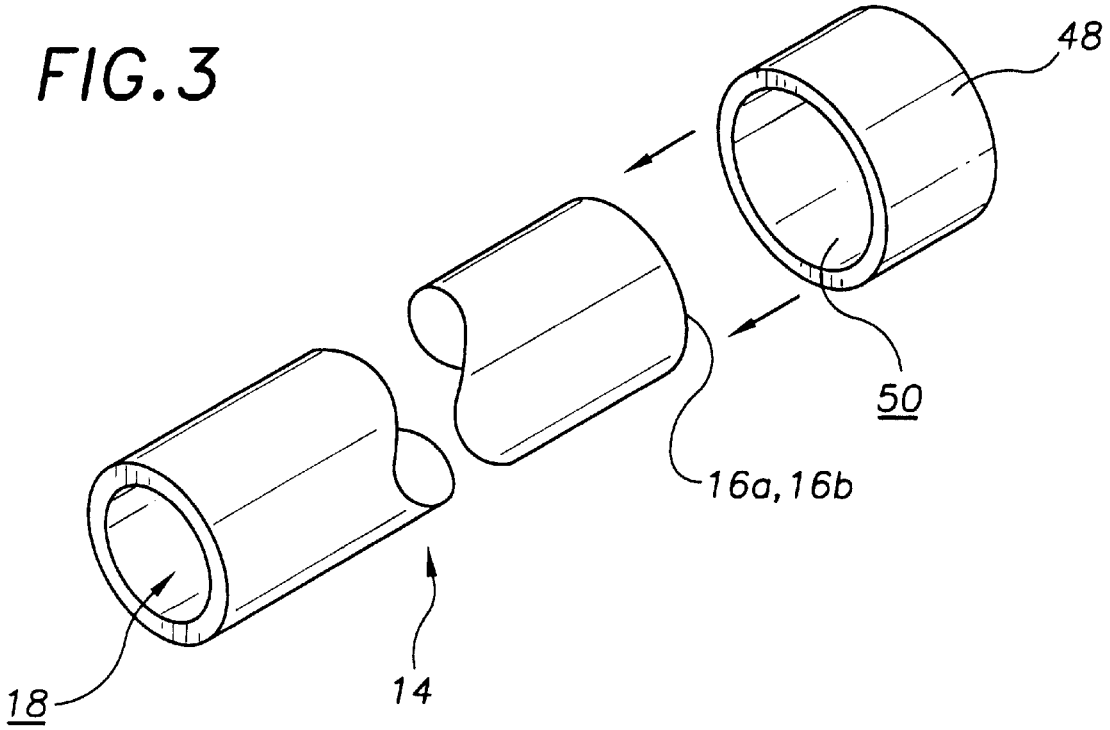
FIG. 3 is a partial perspective view showing the optional straw end sealing cap exploded away from one end of the representative drinking straw.
Figure 4:
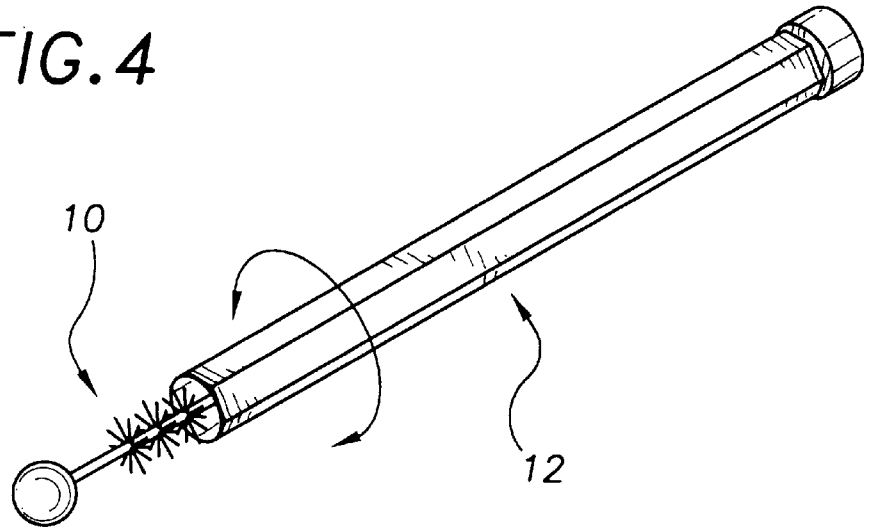
FIG. 4 is a perspective view of the exemplary cleaning system of FIG. 1 in use with the representative drinking straw showing the present invention showing the optional straw end sealing cap secured over one end of the representative drinking straw and the flexible, tubular brush structure inserted into the other end of the representative drinking straw; the drinking straw being cleaning by squirting cleaning solution from the squeezed build cleaning solution reservoir while simultaneously twisting and scrubbing back and forth with the flexible, tubular brush structure.

Referring to FIG. 3, in this embodiment an optional straw end sealing cap 48 is provided that includes a straw end receiving cavity 50 sized to frictionally receive and end 16*a*,16*b* of a drinking straw 12. Straw end sealing cap 48 is optionally used to retain cleaning solution within the straw passageway during a period of brushing with flexible tubular brush structure 20 (FIG. 1).

It can be seen from the preceding description that a drinking straw cleaning system has been provided that includes a flexible, tubular brush structure having a tubular cavity formed therein between a closed insertion end and an open ended, threaded squeeze bulb reservoir connecting end, a number of cleaning solution dispensing orifices provided along the length of the flexible tubular brush structure and a number of multi-length bristles extending radially outward from the flexible tubular brush structure; a resilient, spherical squeeze bulb reservoir having an internal cleaning solution reservoir cavity in connection with a threaded fitting companionately threaded to engage and connect with the threaded squeeze bulb reservoir connecting end of the flexible tubular brush structure; a straw end sealing cap securable over an open end of a drinking straw for maintaining cleaning solution within a straw passageway formed through the drinking straw during a period of brushing with the flexible tubular brush structure; the resilient, spherical squeeze bulb reservoir having an internal cleaning solution reservoir cavity in connection with an internally threaded fitting companionately threaded to engage and connect with the externally threaded squeeze bulb reservoir connecting end of the flexible tubular brush structure.

It is noted that the embodiment of the drinking straw cleaning system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drinking straw cleaning system comprising:

a flexible, tubular brush structure having a tubular cavity formed therein between a closed insertion end and an open ended, an externally threaded squeeze bulb reservoir connecting end, a number of cleaning solution dispensing orifices provided along the length of said flexible tubular brush structure and a number of multi-length bristles extending radially outward from said flexible tubular brush structure; and a resilient, spherical squeeze bulb reservoir having an internal cleaning solution reservoir cavity in connection with a threaded fitting companionately threaded to engage and connect with said threaded squeeze bulb reservoir connecting end of said flexible tubular brush structure;

said resilient, spherical squeeze bulb reservoir having an internal cleaning solution reservoir cavity in connection with the threaded fitting compassionately threaded to engage and connect with said externally threaded squeeze bulb reservoir connecting end of said flexible tubular brush structure.

2. The drinking straw cleaning system of claim 1 further comprising:

a straw end sealing cap securable over an open end of a drinking straw for maintaining cleaning solution within a straw passageway formed through the drinking straw during a period of brushing with said flexible tubular brush structure.

* * * * *